US006997269B1

(12) United States Patent
Putney

(10) Patent No.: US 6,997,269 B1
(45) Date of Patent: Feb. 14, 2006

(54) ATTACHMENT FOR IMPACT HAMMER

(75) Inventor: Gordon A. Putney, Geneva, WI (US)

(73) Assignee: Snap-on Incorporated, Pleasant Prairie, WI (US)

( * ) Notice: Subject to any disclaimer, the term of this patent is extended or adjusted under 35 U.S.C. 154(b) by 69 days.

(21) Appl. No.: 10/400,813

(22) Filed: Mar. 26, 2003

(51) Int. Cl.
*B25D 9/04* (2006.01)

(52) U.S. Cl. ..... 173/29; 173/91; 173/118; 173/121; 173/211

(58) Field of Classification Search ..... 173/29, 173/211, 91, 1, 121, 127, 202, 118; 29/254; 72/705, 435
See application file for complete search history.

(56) References Cited

U.S. PATENT DOCUMENTS

| | | | | |
|---|---|---|---|---|
| 618,324 | A | 1/1899 | Blum | |
| 1,014,295 | A | 1/1912 | Gibb et al. | |
| 1,604,958 | A * | 11/1926 | Bayles | 173/91 |
| 2,791,926 | A * | 5/1957 | Guyton | 72/457 |
| 2,844,007 | A * | 7/1958 | Morehead | 173/118 |
| 3,052,494 | A * | 9/1962 | Williamson | 294/93 |
| 3,109,500 | A * | 11/1963 | Glawon | 173/127 |
| 3,197,987 | A * | 8/1965 | Martin | 72/114 |
| 3,456,739 | A | 7/1969 | Sagae | |
| 3,511,325 | A | 5/1970 | Schmidt | |
| 3,651,873 | A | 3/1972 | Uebel et al. | |
| 3,654,792 | A * | 4/1972 | Mead | 72/391.8 |
| 3,705,633 | A | 12/1972 | Sudinishnikov et al. | |
| 4,073,181 | A | 2/1978 | Steinmann, Jr. | |
| 4,100,975 | A | 7/1978 | Jarman | |
| 4,187,708 | A | 2/1980 | Champoux | |
| 4,446,930 | A * | 5/1984 | Nilsson et al. | 173/29 |
| 4,495,791 | A | 1/1985 | Kemnitz et al. | |
| 4,650,008 | A * | 3/1987 | Simson | 173/91 |
| 4,651,833 | A | 3/1987 | Karpf et al. | |
| 4,658,901 | A | 4/1987 | Alexander | |
| 4,683,960 | A * | 8/1987 | Kostylev et al. | 173/91 |
| 5,108,400 | A | 4/1992 | Appel et al. | |
| 5,163,519 | A | 11/1992 | Mead et al. | |
| 5,210,918 | A * | 5/1993 | Wozniak et al. | 29/254 |
| 5,517,740 | A | 5/1996 | Costlow et al. | |
| 5,638,909 | A * | 6/1997 | Henderson | 173/211 |
| 5,664,328 | A | 9/1997 | Fink et al. | |
| 6,081,983 | A | 7/2000 | Hodgson et al. | |
| 6,223,427 | B1 | 5/2001 | Hodgson et al. | |
| 6,364,288 | B1 | 4/2002 | Laughlin | |
| 6,439,025 | B1 * | 8/2002 | Peters | 72/479 |

* cited by examiner

*Primary Examiner*—Scott A. Smith
(74) *Attorney, Agent, or Firm*—Seyfarth Shaw LLP

(57) ABSTRACT

An attachment for an impact hammer for translating the hammer's typical forwardly directed impact force into a rearwardly directed pulling force while still allowing the user to maintain a conventional orientation of the hammer relative to the work piece intended to be pulled. The attachment comprises a housing defining a cavity with a hammer bit axially movable therein and having an impacting head urged rearwardly by a bias structure which responds to a forward impact force by the impact hammer to cause the hammer bit head to exert impact force on the work piece in a rearward direction.

25 Claims, 4 Drawing Sheets

ATTACHMENT FOR IMPACT HAMMER

BACKGROUND

The present application relates generally to attachments for impact hammers and, more particularly, to an attachment for selectively translating an impact hammer's forwardly directed impacting force into a rearwardly directed pulling force or transferring the forwardly directed impacting force to a work piece.

The removal of a bolt, rivet or the like is a common task which typically requires the application of a great amount of pulling force to enable removal thereof. Typically, for such pulling purposes, a tool specifically adapted for pulling is required. Such tools are typically screw driven or operated by air or hydraulics, have minimal adaptability due to their limited scope of use, and are often cumbersome and heavy.

Attempts have been made to adapt impacting hammers for bolts and like removal. In such a case, the impacting hammer's forwardly directed impacting force is used to push the bolt from the backside of the bolt opposite the head. As such, accessibility to the backside must be available, which is generally not possible.

SUMMARY

The present application discloses an attachment for a typical impact hammer for selectively translating the hammer's typical forward impact force into a rearward pulling force, or conveying the hammer's typical forwardly directed impact force directly to a work piece without the need to remove the attachment.

The attachment comprises a housing defining a cavity with open ends and may have an anvil and a pulling retainer disposed adjacent to the inner wall of the cavity and slideable relative thereto. The opposite end of the housing is adapted to be coupled to the external casing of the impact hammer.

The anvil has an annular wall shoulder with a generally centrally disposed aperture and a pulling retainer integral with the anvil wall and adjacent to the forward terminus thereof, thereby defining an anvil cavity between the anvil shoulder and the pulling retainer. A reinforcing wall may be radially disposed within the cavity adjacent to the anvil should, thereby defining a space between the anvil shoulder and reinforcing wall, and having a wall aperture in substantial axial alignment with the shoulder aperture.

A hammer bit is slidably disposed within the shoulder and wall apertures. A terminal end of the hammer bit may have an impacting head within the anvil cavity and adjacent to the anvil shoulder and having a diameter greater than the shoulder aperture so that the backside of the impacting head can coact with the anvil shoulder. The opposite end of the hammer bit is adapted to be received by the impact hammer internal coupler for coupling engagement therewith. The hammer bit may also have a circumferential channel with a collar disposed therein. A biasing structure may be circumferentially disposed around the hammer bit and between the wall and the collar, thereby urging the impacting head to coact with the anvil shoulder when the attachment is configured in a pulling mode.

During operation in a pulling mode, the user fixedly couples a work piece to the pulling retainer via an extraction bit. By applying a rearwardly directed force to the impact hammer, the housing translates rearwardly relative to the work piece and the anvil and pulling retainer, because they are fixedly coupled to the work piece. At the housing's rearward extent, the distance between the impacting head and the pulling retainer increases wherein the back side of the impacting head readily coacts with the anvil shoulder. Upon activation, the impact hammer actuates the hammer bit in a generally axial, forward manner, thus causing the impacting head to progress away from the anvil shoulder and accumulate potential energy within the biasing structure. Upon dissipation of the impact hammer's actuating force, and prior to the impacting head coacting with the pulling retainer, the biasing structure releases its potential energy to the hammer bit, thereby forcing the impacting head to impact the anvil shoulder with a force having a substantially rearwardly directed vector. The anvil shoulder subsequently conveys the generally rearwardly directed force to the coupled work piece via the integral pulling retainer in a well-known pulling manner.

During operation in an impacting configuration, the user may couple a well-known impacting extension bit to the pulling retainer which in turn coacts with a work piece intended to be impacted. By applying a forwardly directed force to the impact hammer, the housing translates forwardly relative to the work piece and the anvil and pulling retainer. At the housing's forward extent, the distance between the anvil shoulder and the inner wall decreases and the impacting head is positioned to coact with the rear side of the pulling retainer. The impact hammer may actuate the hammer bit with a forwardly directed force thus causing the impacting head to directly coact with the rear side of the pulling retainer thereby conveying the forwardly directed impacting force to the work piece in a well known manner.

BRIEF DESCRIPTION OF THE DRAWINGS

For the purpose of facilitating an understanding of the subject matter sought to be protected, there is illustrated in the accompanying drawings embodiments thereof, from an inspection of which, when considered in connection with the following description, the subject matter sought to be protected, its construction and operation, and many of its advantages, should be readily understood and appreciated.

DETAILED DESCRIPTION

The present application discloses an attachment for a typical impact hammer, or other device capable of transmitting a forwardly directed impacting force, allowing a user to selectivity translate the impact hammer's normal axial, forwardly directed impacting force into a substantially rearwardly directed pulling force, wherein a work piece to be pulled can be oriented forwardly of the impact hammer in a well-known manner. An embodiment of the attachment may also be used to impart a forwardly directed impacting force to a work piece. The impact hammer may be pneumatically, electrically or hydraulically operated.

Figure 6:
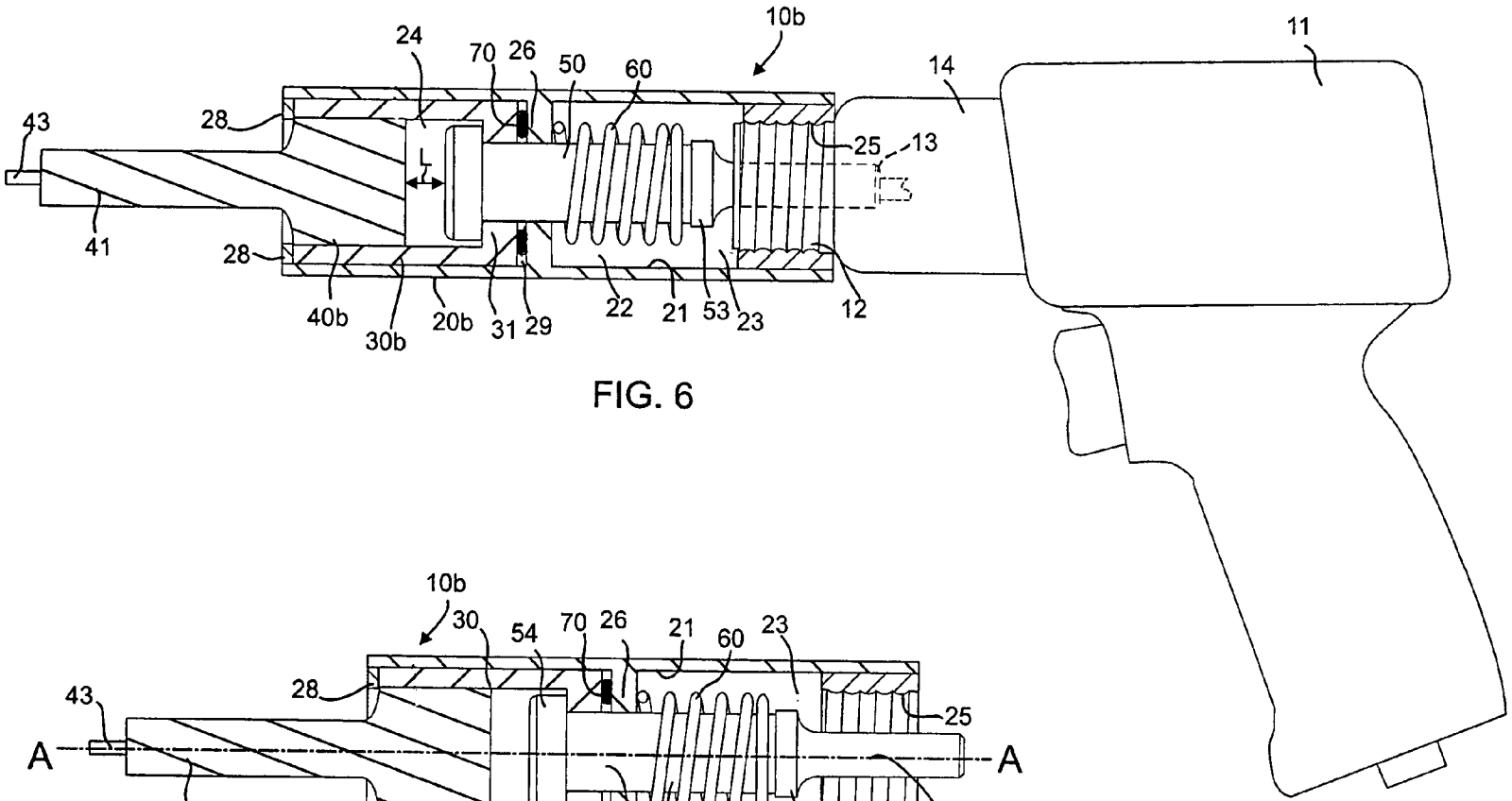
FIG. 6 is a cross-sectional view of the attachment of FIG. 5 coupled to a typical impact hammer.

Referring to FIG. 6, there is shown a typical impact hammer 11, with which an attachment of the present application may be used, the hammer 11 having an internally disposed coupler 13 for coupling engagement with a typical impacting bit and capable of actuating the impacting bit in a repetitive, substantially forwardly directed, axial manner. The impact hammer 11 has an external casing 14 which may be provided with an externally disposed annular coupling collar 12 for coupling engagement with an impact hammer attachment. The coupling collar 12 may include a circumferentially disposed screw-type thread.

Figure 1:
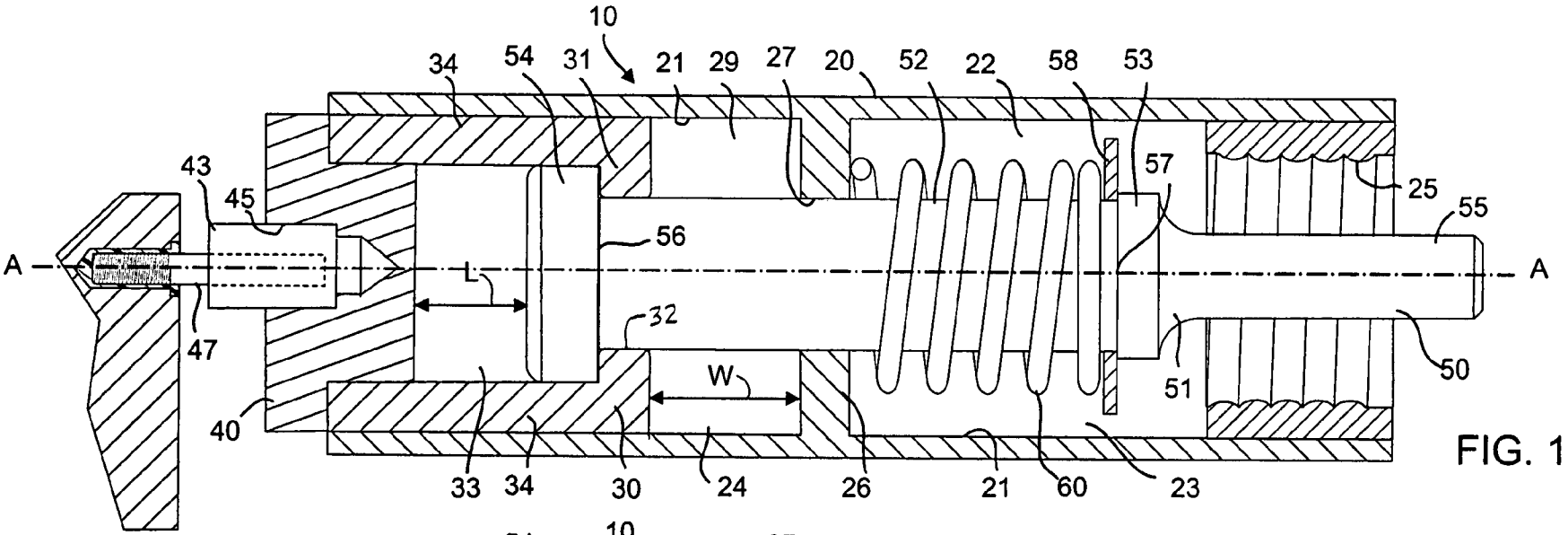
FIG. 1 is a cross-sectional view of an embodiment of an attachment in accordance with the present application configured in a rearward pulling-mode.
Figure 2:
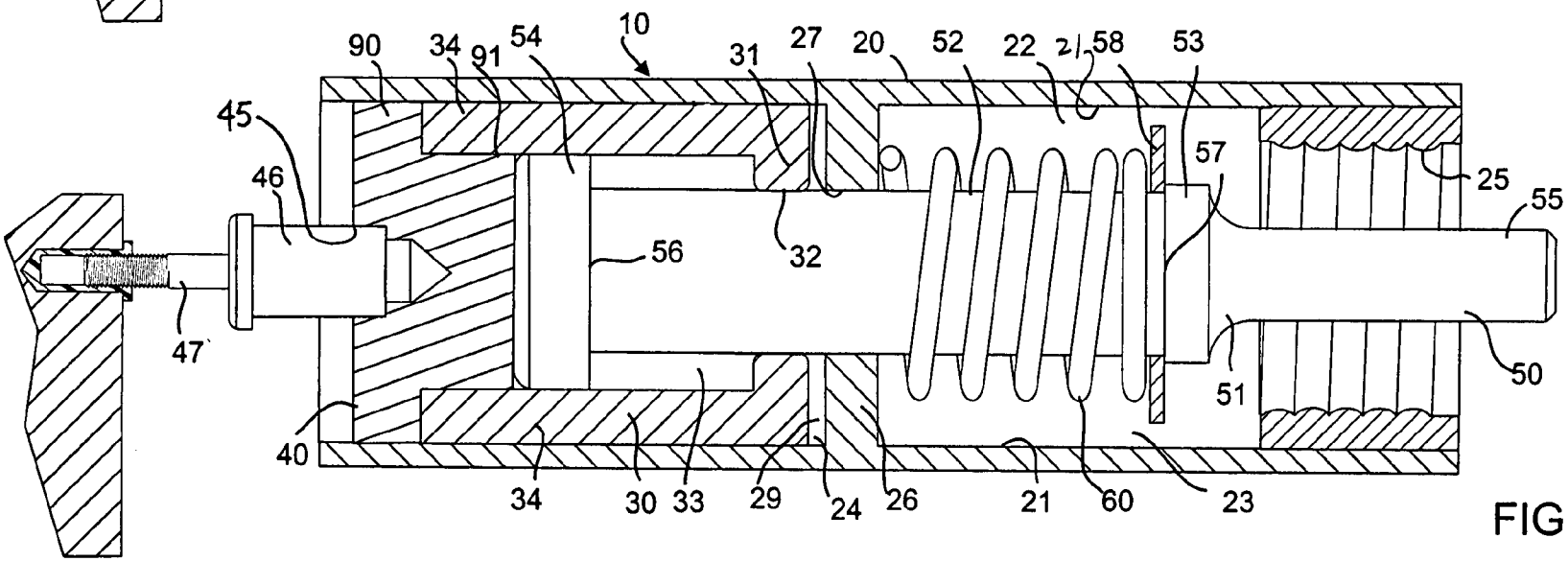
FIG. 2 is a cross-section view of the attachment of FIG. 1 configured in a forward impacting-mode.

The embodiments of the attachment of the present application will now be described. Referring to FIGS. 1–2, an attachment 10 comprises a housing 20 defining a cavity 22 having a longitudinal axis A—A (FIG. 1). The housing 20 may have a generally cylindrical shape. The cavity 22 has an inner wall 21 and axial openings respectively at opposite ends in communication with the cavity 22. The inner wall 21 may have an integrally disposed transverse reinforcing wall 26 thereby defining proximal and distal portions 23, 24 of cavity 22. The reinforcing wall 26 may be radial and may be integrally disposed with the inner wall 21 of the housing 20 in the approximate middle of the cavity 22, but it will be appreciated that the reinforcing wall 26 may be integrally disposed at any location within the cavity 22. The reinforcing wall 26 may have a generally centrally disposed wall aperture 276 defining a wall bushing.

The inner wall 21 of the proximal portion 23 may include a coupler 25 adapted for coupling engagement with the annular coupling collar 12 of the hammer 11. The coupler 25 may include a circumferentially disposed complementary thread for threaded engagement with the screw-type thread of the coupling collar 12 of the hammer 11.

An anvil 30 may be slideably disposed in the distal portion 24 of cavity 22 forwardly of the reinforcing wall 26. The anvil 30 may have a cylindrical anvil side wall 34 adjacent to the inner wall 21 and substantially coaxial therewith. The anvil 30 rearwardly terminates with a generally transverse anvil shoulder 31 and adjacent to the reinforcing wall 26 thereby defining a space between the anvil 30 and the reinforcing wall 26 having a width W. The anvil 30 may thus be generally cup-shaped. The anvil shoulder 31 may include a generally centrally disposed shoulder aperture 32 having an anvil shoulder diameter and cross-sectional area and in substantial axial alignment with the wall aperture 27 and thereby defining a shoulder bushing.

A pulling retainer 40 may be integral with the anvil side wall 34 and disposed adjacent to the forward terminus thereof. The pulling retainer 40 may have a shoulder portion 90 adjacent to the anvil wall 34 and terminating in an external portion 91 adapted to be received by the anvil 30. The external portion 91 may be adapted to be threaded to the anvil wall 34 in a well-known manner for cooperation therewith to define an anvil cavity 33. The pulling retainer 40 may have a generally central, outwardly disposed pulling retainer coupling 45 adapted for coupling engagement with an extraction bit 43 or an impacting extension bit 46 in a well known manner.

A hammer bit 50 is slideably disposed through the wall and shoulder apertures 27, 32 in a generally axial manner. As such, the hammer bit 50 extends between the proximal and the distal portions 23, 24 of the cavity 22. The hammer bit 50 may have a first portion 51 disposed within the proximal portion 23 of the cavity 22 and extending generally outwardly therefrom and a second portion 52 extending between the proximal and distal portions 23, 24 of the cavity 22 and slideable through the wall and shoulder apertures 27, 32. The first portion 51 terminus may be adapted for coupling engagement with the coupler 13 of the hammer 11.

The second portion 52 terminus may terminate in a generally transverse impacting head 54 disposed within the anvil cavity 33. Within the anvil cavity 33, in the position depicted in FIG 1, the impacting head 54 is spaced from the backside of the pulling retainer 40 by a distance L. The impacting head 54 may have a lateral area greater than the anvil shoulder aperture cross-sectional area, thus allowing the impacting head 54 to coact with the anvil shoulder 31.

The first and second portions 51, 52 may respectively be separated by a circumferential channel having a collar 58 disposed therein. The first portion 51 may have a diameter less than the diameter of the second portion 52. In another embodiment, the first and second portions 51, 52 may be respectively be separated by an integral, transversely outwardly extending flange 53. The flange 53 may have a substantially flattened portion disposed adjacent to and facing the second portion 52 to define a flange shoulder 57.

A biasing structure 60 may be provided to resiliently urge the hammer bit 50 rearwardly toward the hammer 11. The biasing structure 60 may include a compression spring circumferentially disposed around the second portion 52 of the bit hammer 50 and between the collar 58 and the reinforcing wall 26. Collar 58 may comprise a radial washer.

Referring again to FIG. 1, it will be appreciated that when the user intends to pull on a work piece 47, the user fixedly couples the extraction bit 43 to the work piece 47 and pulls the housing 20 rearwardly, thus moving the housing 20, reinforcing wall 26 and hammer bit 50 rearwardly relative to the anvil 30 and the pulling retainer 40 until the hammer bit 50 engages the anvil shoulder 31, causing the distance W between the anvil shoulder 31 and reinforcing wall 26 and the distance L between the head 54 and pulling retainer 40 to increase. This extended position will cause the impacting head 54 to coact with the anvil shoulder 31 and dispose the pulling retainer 40 relative to the impacting head 54 wherein the impacting head 54 cannot coact with the rear side of the pulling retainer 40.

In such a rearwardly pulling-mode, actuation of the hammer bit 50 in a forward direction by the impact hammer 11 causes the impacting head 54 to progress away from the anvil shoulder 31 with a force having a substantially forwardly directed vector, and at the same time, accumulate potential energy within the biasing structure 60 by compressing the same. When the forward driving force exerted by the impact hammer 11 is exhausted, and prior to the impacting head 54 coacting with the pulling retainer 40, the potential energy within the biasing structure converts to kinetic energy and drives the impacting head 54 substantially rearwardly to impact the anvil shoulder 31 with a force having a substantially rearwardly directed vector. The anvil shoulder 31 subsequently conveys the substantially rearwardly directed force vector to the anvil side wall 34 and to the integral pulling retainer 40, thus causing a substantially rearwardly directed pulling force on the extraction bit 43 and the operatively coupled work piece.

Referring again to FIG. 2, it will be appreciated that the attachment 10 can be configured to impact a work piece by attaching an impacting extension bit 46 to the pulling retainer 40 and causing a forwardly directed force to be conveyed to the work piece. In this case, the impact hammer 11 is pushed forwardly by the user, thus moving the housing 20, reinforcing wall 26 and hammer bit 50 forwardly relatively to the anvil 30 and the pulling retainer 40, reducing the distance W between the anvil shoulder 31 and the reinforcing wall 26 and the distance L between the backside of the pulling retainer 40 and impacting head 54, thus causing the impacting head 54 to coact directly with the pulling retainer 40. Actuation of the hammer bit 50 with a forwardly directed impacting force from the impact hammer 11 causes the impacting head 54 to operatively drive the back side of the pulling retainer 40, thus transferring the forwardly directed impacting force to the impacting extension 46 and the work piece.

Figure 5:
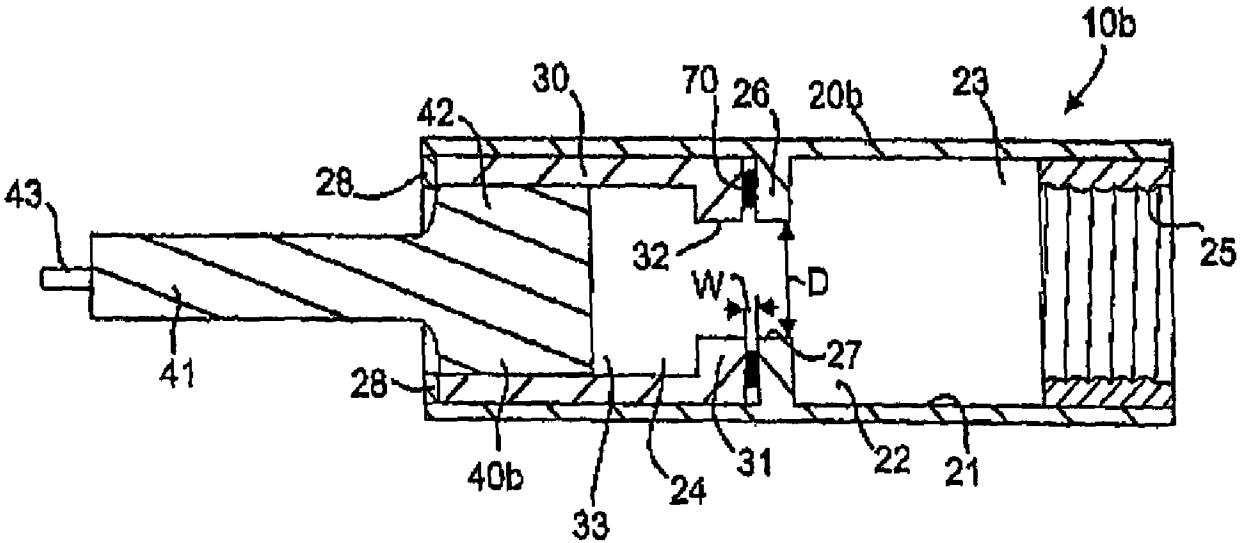
FIG. 5 is a cross-sectional view of an other embodiment of an attachment in accordance with the present application with the hammer bit and biasing structure removed for clarity.
Figure 7:
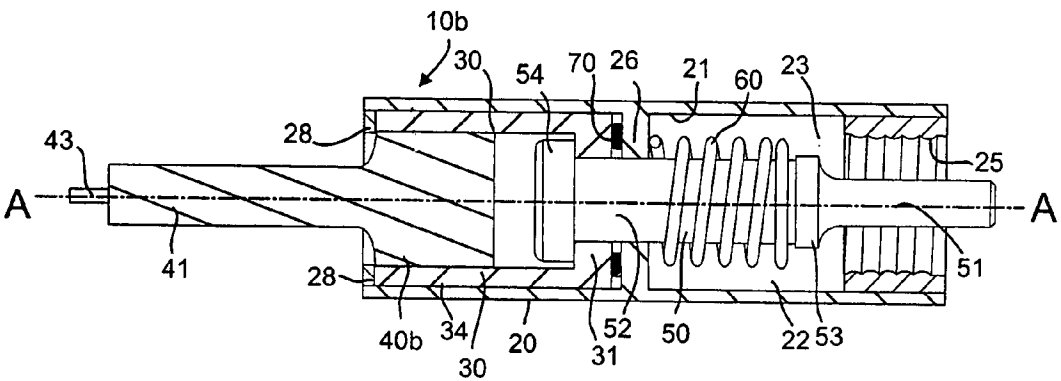
FIG. 7 is a cross-sectional view of the attachment of FIG. 5 uncoupled from a typical impact hammer.

Referring also to FIGS. 5–7, another embodiment of an attachment 10*b* is shown, wherein common elements of the attachments 10 and 10*b* have bee depicted with like numerals. The housing 20*b* is substantially similar to the housing 20 previously described and further includes a stop 28, which may be in the form of a radially, inwardly extending lip, on the inner wall 21 adjacent to the forward end thereof. The anvil 30*b* may be therein be disposed in the cavity 22 forwardly of the reinforcing wall 26 and have an anvil side wall 34 adjacent to the inner wall 21 with a forward terminus adjacent to the stop 28.

A shock absorbing structure 70 may be disposed between the anvil shoulder 31 and the reinforcing wall 26. The shock absorbing structure 70 may include a compression spring circumferentially disposed around the second portion 52 of the hammer bit 50. The shock absorbing structure may also include a pad of a resilient, compressible material.

The pulling retainer 40*b* may include an integral, generally outwardly extending portion 41 terminating with a coupler adapted to be coupled to an extraction bit 43. It will be appreciated that the extraction bit 43 will be operatively and fixedly coupled to a work piece intended to be pulled and the impacting extension 46 will be adapted to convey a forwardly directed impact force to a work piece 47.

It will be appreciated that actuation of the pull hammer 50 in a forward direction by the impact hammer 11 will cause the impacting head 54 to move away from the anvil shoulder 31 with a force having a substantially forwardly directed vector, and, at the same time, accumulate potential energy within the biasing structure 60. When the forward driving force exerted by the impact hammer 11 is removed from the pull hammer 50, the potential energy within the biasing structure converts to kinetic energy and drives the impacting head 54 rearwardly to impact the anvil shoulder 31 with a force having a substantially rearwardly directed vector. The anvil shoulder 31 thus translates the substantially rearwardly directed force vector to the anvil side wall 34 and to the integral pulling retainer 40*b*, thus producing a substantially rearwardly directed pulling force on the extraction bus 43 and the operatively coupled work piece.

Figure 3:
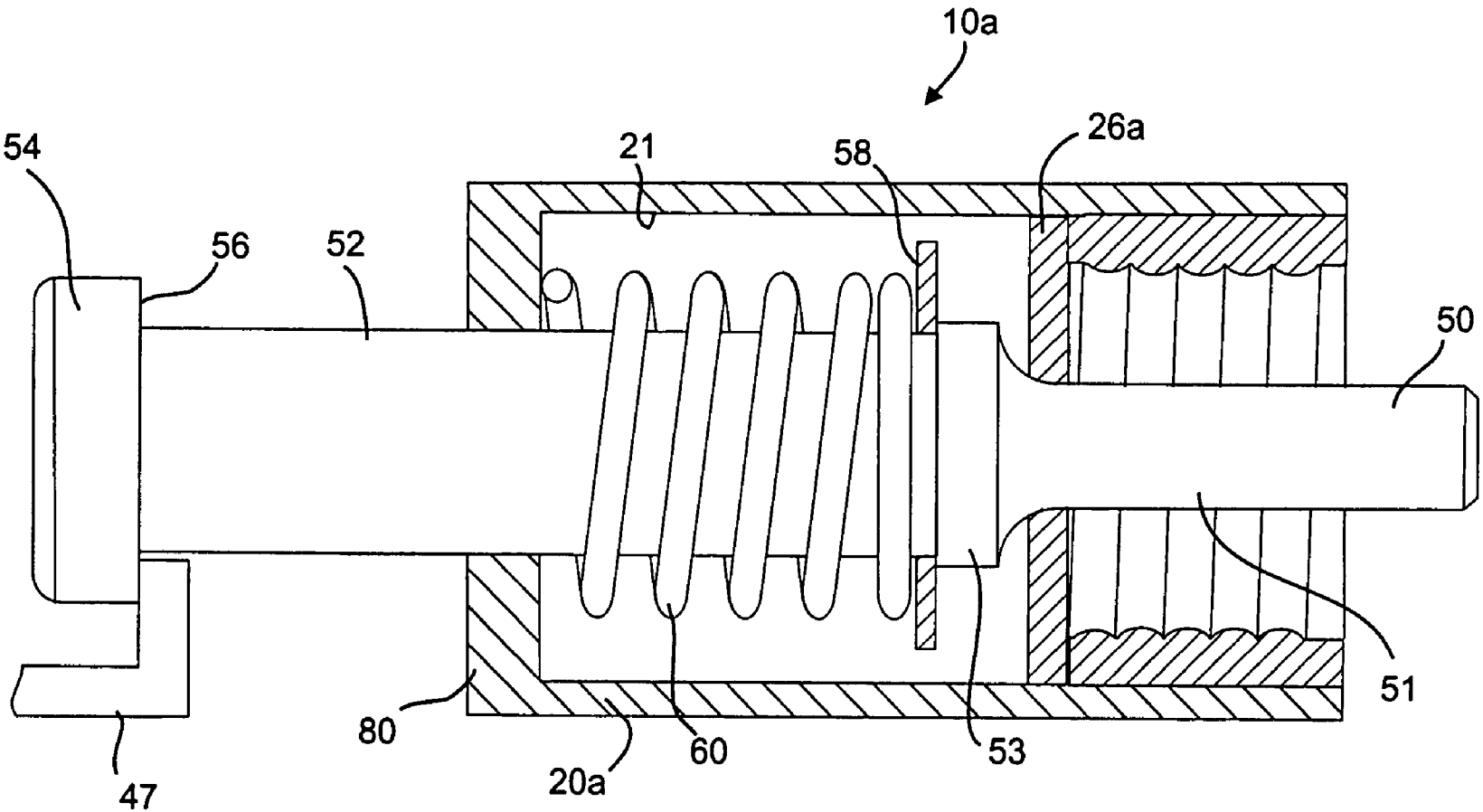
FIG. 3 is a cross-sectional view of another embodiment of an attachment in accordance with the present application.
Figure 4:
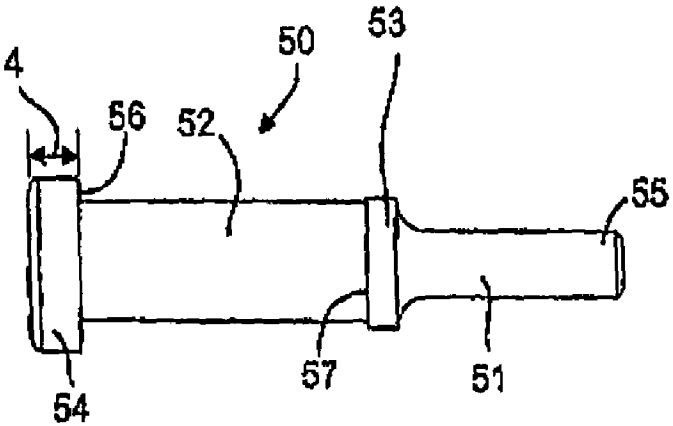
FIG. 4 is a reduced, side view of the hammer bit of the attachment of FIG. 1.

Referring to FIG. 3, another embodiment of an attachment 10*a* is shown wherein like elements of the attachments 10 and 10*a* have been depicted with like numerals. In such an embodiment, the housing 20*a* may be substantially similar to the housing 20 described above, but may be shorter in length wherein the impacting head 54 may extend substantially generally outwardly from the forward end of the housing 20*a*. An inwardly extending end wall 80 may be integrally disposed with the housing 20*a* adjacent to the forward opening of the housing 20*a*. The end wall has a generally centrally disposed aperture in substantial axial alignment with the wall aperture 27 and thereby defining an end wall bushing. The reinforcing wall 26*a* may be integrally disposed with the inner wall 21 is such a position to facilitate the disposal of the collar 58 forwardly of the wall 26*a*. As such, the biasing structure 60 is circumferentially disposed around the hammer bit 50 and between the collar 58 and the end wall 80.

In this embodiment, it will be appreciated that when the user intends to pull on a work piece 47, the user disposes the impacting head 54 relative to the work piece to permit the back side of the impacting head 54 to coact with the work piece 47 to be pulled. It is anticipated that the work piece will have a lip or other accessible extension to facilitate the same. The impact hammer 11 actuates the hammer bit 50 in a forwardly directed manner, thereby causing the impacting head 54 to move away forwardly from the work piece 47 and, at the same time, accumulate potential energy within the biasing structure 60. When the forward driving force is removed, the potential energy in the biasing structure 60 converts to kenetic energy and drives the impacting head 54 rearwardly, causing the backside of the impacting head 54 to impact the work piece 47 with a force having a substantially rearwardly directed vector.

A method of using a typical impact hammer having an external casing and a coupler to exert a pulling force on a work piece located forwardly of the impact hammer is also disclosed. The method comprises providing a housing with an internal hammer bit axially movable relative to the housing, attaching the housing to the external casing, coupling the hammer bit to the coupler, biasing the hammer bit rearwardly toward the impact hammer, orienting the impact hammer so the work piece is located forwardly of the impact hammer, coupling the work piece to the hammer bit, causing the impact hammer to forwardly move the hammer bit disposed with a forwardly directed vector against the rearward bias; and removing the forwardly directed vector so that the rearward bias will cause the hammer bit to exert a generally rearwardly directed pulling force on the work piece.

The step of attaching a housing to the impact hammer includes disposing the anvil in a cavity defined by the housing and having first and second openings respectively at the terminal ends, the anvil having an annular anvil shoulder with a generally centrally disposed shoulder aperture slideably disposing the hammer bit having first and second portions within the shoulder aperture in a generally axial manner, the second portion extending through the shoulder aperture and toward the pulling shank and terminating in an impacting head defining a head shoulder with a backside adjacent the anvil shoulder, the first portion extending toward the second opening and adapted for connectable engagement with the impact hammer, attaching the hammer bit to the impact hammer, and biasing the backside of the head shoulder toward the anvil shoulder with a biasing structure.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

I claim:

1. An attachment for a device having an external casing and an internally disposed coupler for moving a connectable extension in a generally forward manner, the attachment comprising:

a housing defining a cavity with an inner wall and having an axis and axial end openings communicating with the cavity and further having an integrally disposed transverse reinforcing wall having a generally centrally disposed wall aperture thereby defining a proximal portion and a distal portion of the cavity;

a coupling mechanism for coupling the proximal portion of the cavity to the device casing;

an anvil disposed in the cavity forwardly of the reinforcing wall and having a transverse anvil shoulder with a generally centrally disposed shoulder aperture in substantial axial alignment with the wall aperture and having a shoulder aperture cross-sectional area;

a pulling retainer integral with the anvil;

a hammer bit having a first end and a second end separated by a collinear disposed thereon and being slideably disposed through the reinforcing wall and shoulder apertures in a generally axial manner, the first end terminating in an impacting head defining a head shoulder having a lateral area greater than the shoulder aperture cross-sectional area, the second end extending toward the proximal portion and adapted for connection to the coupler; and a biasing structure for resiliently urging the impacting head toward the anvil shoulder.

2. The attachment as claimed in claim 1 wherein the pulling retainer includes an integral extension extending generally outwardly from the housing and terminating with a coupler for coupling engagement with an extraction bit.

3. The attachment as claimed in claim 1 wherein the pulling retainer includes a generally centrally disposed coupling adapted for engagement with an extraction or extension bit.

4. The attachment as claimed in claim 1 further comprising a stop integral with the inner wall and adjacent to the anvil.

5. The attachment as claimed in claim 4 wherein the stop includes a radially inwardly extending lip disposed adjacent to the anvil.

6. The attachment as claimed in claim 1 wherein the device is an impact hammer.

7. The attachment as claimed in claim 1 wherein the housing is generally cylindrical in shape.

8. The attachment as claimed in claim 1 wherein the biasing structure includes a compression spring disposed around the hammer bit and between the collar and the reinforcing wall.

9. The attachment as claimed in claim 1 further comprising a shock absorbing structure disposed between the anvil shoulder and the transverse reinforcing wall.

10. The attachment as claimed in claim 9 wherein the shock absorbing structure includes a compression spring disposed around the hammer bit.

11. An attachment for an impact hammer having an external casing and an internally disposed coupler for moving a connectable impacting bit in a generally forward axial impacting hammer, the attachment comprising:

a generally cylindrical housing defining a cavity, the cavity having a distal portion and a proximal portion with respective axial openings extending thereinto and being separated from each other by a transversely disposed wall having a wall aperture centrally disposed therein, the housing adjacent to the proximal portion having a coupling mechanism for coupling the proximal portion of the cavity to the casing;

an anvil disposed within the distal portion and having a transverse anvil shoulder, the anvil shoulder having a centrally disposed shoulder aperture in substantial axial alignment with the wall aperture;

a pulling retainer integral with the anvil forwardly of the anvil shoulder thereby defining an anvil cavity between the anvil shoulder and the pulling retainer;

a hammer bit slideably disposed through the wall and shoulder apertures in a generally axial manner thereby extending between the distal and proximal portions of the cavity and having a first portion disposed within the proximal portion of the cavity and a second portion spanning the distal and proximal portions of the cavity, the first and second portions being separated by a collar disposed on the hammer bit, a terminal end of the first portion adapted to be coupled to the coupler, the second portion terminating in an impacting head defining a head shoulder disposed within the anvil cavity; and a biasing structure for resiliently urging the head shoulder toward the anvil shoulder.

12. The attachment as claimed in claim 11 further comprising a stop integrally disposed within the inner wall of the distal portion and adjacent to the opening.

13. The attachment as claimed in claim 12 wherein the stop includes a generally inwardly extending lip.

14. The attachment as claimed in claim 11 wherein the biasing structure includes a compression spring disposed around the second portion of the hammer bit and between the collar and the transversely disposed wall.

15. The attachment as claimed in claim 11 further comprising a shock absorbing structure disposed between the anvil shoulder and the wall.

16. An attachment for an impact hammer having an external casing and capable of creating a forwardly directed impacting force, the attachment comprising:

a housing attachable to the impact hammer external casing; and a means for translating the forwardly directed impacting force into a rearwardly directed pulling force while maintaining conventional orientation of the impact hammer relative to a work piece.

17. An attachment as claimed in claim 16 wherein the means for translating the impacting force into a pulling force includes a rearwardly biased hammer bit slideably disposed within the housing.

18. An attachment as claimed in claim 17 wherein the means for translating the impacting force into a pulling force includes an anvil disposed within the housing and being in operable communication with the hammer bit.

19. An attachment as claimed in claim 18 wherein the means for translating the impacting force into a pulling force includes a pulling retainer integrally disposed with the anvil.

20. An attachment as claimed in claim 16 wherein the means for translating the impacting force into a pulling force includes:

a cavity defined by the housing with an inner wall and having proximal and distal portions with respective axial openings extending thereinto, the inner wall of the proximal portion adapted for coupling engagement with the external housing of the impact hammer;

an anvil disposed adjacent to the inner wall of the distal portion and having an annular anvil shoulder with a generally centrally disposed shoulder aperture;

a pulling retainer integral with the anvil;

a hammer bit having first and second portions separated by a collar disposed thereon and being slideably disposed through the shoulder aperture in a generally axial manner, the second portion extending through the shoulder aperture and toward the distal portion of the cavity and terminating in an impacting head defining a head shoulder adjacent to the anvil shoulder, the first portion extending toward the proximal portion and adapted for connectable engagement with the impact hammer; and a biasing structure for urging the head shoulder toward the anvil shoulder.

21. An apparatus to cause a pulling force to be conveyed to a work piece oriented forwardly of the apparatus, comprising, in combination:

an impact hammer having an external casing and an internally disposed bit coupler for moving a connectable extension in a generally forward axial manner; and an attachment having a housing with an axis and adapted to be attached to the external casing, the housing defining a cavity with a proximal portion and a distal portion separated by a radially disposed wall having a wall aperture and having respective axial openings therein communicating with the cavity, a coupling mechanism disposed in the proximal portion of the cavity to couple the housing to the apparatus casing, an anvil disposed in the distal portion and having a transverse anvil shoulder with a generally centrally disposed shoulder aperture having a shoulder aperture cross-sectional area, a pulling retainer integral with the anvil and having a coupler for coupling engagement with an extraction or impact extension bit, a hammer bit having a first end and a second end separated by a collar disposed thereon and being slideably disposed through the shoulder aperture in a generally axial manner, the first end extending through the shoulder aperture and toward the distal portion and terminating in an impacting head defining a transverse head shoulder adjacent to the anvil shoulder and having a lateral area greater than the shoulder aperture cross-sectional area, the second end extending toward the proximal portion and adapted for connection to the coupler device; and a biasing structure for resiliently urging the head shoulder toward the anvil shoulder.

22. The attachment as claimed in claim 21 wherein the housing is generally cylindrical.

23. The attachment as claimed in claim 21 wherein the biasing structure includes a compression spring disposed around the pull hammer and between the collar and the wall.

24. The attachment as claimed in claim 21 further comprising a shock absorbing structure disposed between the anvil shoulder and the wall.

25. An attachment for an impact hammer having an external casing and an internally disposed coupler for moving a connectable impacting bit in a generally forward axial impacting manner, the attachment comprising:

a generally cylindrical housing defining a cavity, the cavity having a distal portion and a proximal portion with respective axial openings extending thereinto and being separated from each other by a transversely disposed wall having a wall aperture centrally disposed therein, the housing adjacent to the proximal portion having a coupling mechanism for coupling the proximal portion of the cavity to the casing;

an anvil disposed within the distal portion and having a transverse anvil shoulder, the anvil shoulder having a centrally disposed shoulder aperture in substantial axial alignment with the wall aperture;

a pulling retainer integral with the anvil forwardly of the anvil shoulder thereby defining an anvil cavity between the anvil shoulder and the pulling retainer;

a hammer bit slideably disposed through the wall and shoulder apertures in a generally axial manner thereby extending between the distal and proximal portions of the cavity and having a first portion disposed within the proximal portion of the cavity and a second portion spanning the distal and proximal portions of the cavity, the first and second portions being separated by a collar disposed on the hammer bit, a terminal end of the first portion adapted to be coupled to the coupler, the second portion terminating in an impacting head defining a head shoulder disposed within the anvil cavity; and a compression spring disposed around the second portion of the hammer bit and between the collar and the transversely disposed wall for resiliently urging the head shoulder toward the anvil shoulder.

* * * * *

UNITED STATES PATENT AND TRADEMARK OFFICE

CERTIFICATE OF CORRECTION

PATENT NO. : 6,997,269 B1
DATED : February 14, 2006
INVENTOR(S) : Gordon A. Putney It is certified that error appears in the above-identified patent and that said Letters Patent is hereby corrected as shown below:

Column 7,
Line 16, "collinear" should be -- collar --.
Line 57, "hammer" should be -- manner --.

Signed and Sealed this

Sixteenth Day of May, 2006

JON W. DUDAS
*Director of the United States Patent and Trademark Office*